US007670388B2

(12) United States Patent
Sugano et al.

(10) Patent No.: US 7,670,388 B2
(45) Date of Patent: Mar. 2, 2010

(54) FIBER-TREATING COMPOSITION

(75) Inventors: Ikuo Sugano, Wakayama (JP); Yusuke Yamane, Wakayama (JP)

(73) Assignee: KAO Corporation, Tokyo (JP)

( * ) Notice: Subject to any disclaimer, the term of this patent is extended or adjusted under 35 U.S.C. 154(b) by 650 days.

(21) Appl. No.: 11/546,396

(22) Filed: Oct. 12, 2006

(65) Prior Publication Data

US 2007/0089243 A1 Apr. 26, 2007

(30) Foreign Application Priority Data

Oct. 14, 2005 (JP) ..... 2005-299758

(51) Int. Cl.

| | |
|---|---|
| ***C11D 3/00*** | (2006.01) |
| ***C11D 3/22*** | (2006.01) |
| ***C11D 3/37*** | (2006.01) |
| ***D06M 15/643*** | (2006.01) |
| ***D06C 27/00*** | (2006.01) |
| ***D06C 29/00*** | (2006.01) |

(52) U.S. Cl. ..... 8/115.51; 252/8.61; 252/8.81

(58) Field of Classification Search ..... 8/115.51; 252/8.61, 8.81

See application file for complete search history.

(56) References Cited

U.S. PATENT DOCUMENTS

| | | | | |
|---|---|---|---|---|
| 5,753,166 | A | 5/1998 | Dalton et al. | |
| 5,798,107 | A | 8/1998 | Vogel et al. | |
| 6,416,557 | B1 * | 7/2002 | Ona et al. | 8/115.51 |
| 6,541,614 | B1 | 4/2003 | Nagasawa et al. | |
| 7,125,831 | B2 * | 10/2006 | Azuma et al. | 510/285 |

FOREIGN PATENT DOCUMENTS

| | | | |
|---|---|---|---|
| EP | 1369101 | A1 | 12/2003 |
| EP | 1369102 | A1 | 12/2003 |
| EP | 1066020 | B1 | 8/2005 |
| EP | 1586694 | A2 | 10/2005 |
| GB | 1022097 | | 3/1966 |
| JP | 5-44169 | A | 2/1993 |
| JP | 5-239774 | A | 9/1993 |
| JP | 8-260356 | A | 10/1996 |
| JP | 9-13272 | A | 1/1997 |
| JP | 9-111662 | A | 4/1997 |
| JP | 10-508911 | A | 9/1998 |
| JP | 10-508912 | A | 9/1998 |
| JP | 11-229266 | A | 8/1999 |
| JP | 2000-129570 | A | 5/2000 |
| JP | 2000-129577 | A | 5/2000 |
| JP | 2000-129578 | A | 5/2000 |
| JP | 2000-239970 | A | 9/2000 |
| JP | 2003-89978 | A | 3/2003 |
| WO | WO-96/15309 | A2 | 5/1996 |
| WO | WO-96/15310 | A2 | 5/1996 |
| WO | WO-0073351 | A1 | 12/2000 |
| WO | WO 2004091557 | A2 * | 10/2004 |

OTHER PUBLICATIONS

English language abstract of JP 2000-129577 A (May 9, 2000).
Shin-Etsu Silicone, Silicone Products for Personal Care, pps. pp. 2-11, Oct. 2008.

* cited by examiner

*Primary Examiner*—Lorna M Douyon
*Assistant Examiner*—Tanisha Diggs
(74) *Attorney, Agent, or Firm*—Birch, Stewart, Kolasch, & Birch, LLP.

(57) ABSTRACT

Disclosed is a fiber-treating agent composition comprising an oil-in-water emulsion wherein composition (A) comprising the following component (b) is emulsified with the following component (a): a polymer compound of a polysaccharide derivative, and component (b): a polyether-modified silicone having an HLB value of larger than zero to 7 or smaller; wherein the mass ratio of the component (a) to the component (b) in the composition, that is, the component (a)/component (b), is 9/100 to 30/100.

5 Claims, No Drawings

FIBER-TREATING COMPOSITION

FIELD OF THE INVENTION

The present invention relates to a fiber-treating agent composition containing an oil-in-water-type emulsion.

BACKGROUND OF THE INVENTION

A silicone compound is applied to various fields such as detergent, finisher, fiber-treating agent and lubricant, and particularly a finisher for textile products such as clothes is widely used for the purpose of conferring an effect of improving the feel of an object. Many techniques of using a silicone compound in combination with a polymer compound are also disclosed. JP-A 2000-129570, JP-A 2000-129577, JP-A 2000-129578, JP-A2000-239970, JP-A2003-89978, JP-A5-239774, JP-A 8-260356, JP-A 9-13272, JP-A 9-111662, JP-A 11-229266, JP-A 10-508911, JP-A 10-508912 and JP-A No. 5-44169 disclose respectively a fiber-treating agent composition containing both a water-soluble polymer compound generally known as a starch base and a silicone compound. WO-A 00/73351 discloses a specific polysaccharide derivative, and it is described that the polysaccharide derivative in WO-A 00/73351 can stabilize hydrophobic compounds.

DISCLOSURE OF THE INVENTION

The present invention provides a fiber-treating agent composition containing an oil-in-water-type emulsion wherein composition (A) containing the following component (b) is emulsified with the following component (a):

component (a): a polymer compound containing constituent unit (a1) having 2 to 20 carbon atoms in total and having at least one group selected from a hydroxy group, a carboxylic acid group, a quaternary ammonium group, an amino group and an amide group, provided that constituent unit (a2) is excluded, and constituent unit (a2) having a C8 to C22 hydrocarbon group, in a (a1)/(a2) molar ratio in the range of 100/30 to 1000/1, and component (b): a polyether-modified silicone having an HLB value of larger than zero to 7 or smaller.

DETAILED DESCRIPTION OF THE INVENTION

The silicone compound is a water-insoluble compound, and for application to an aqueous composition such as a finisher for washing clothes used in ordinary households, the silicon compound is incorporated into an aqueous composition after emulsification with a surfactant. Such an aqueous composition is often added at the stage of rinsing in washing steps, and a method of diluting the aqueous composition with a large excess of water and contacting it with textile products such as clothes is used. However, the silicone compound emulsified with a surfactant etc. cannot be stably present because its emulsification is broken due to an extreme reduction in the emulsifying power of the surfactant upon dilution with a large excess of water. Under the present circumstances, therefore, the silicone compound cannot be sufficiently adsorbed into fibers, and thus a majority of the silicone compound in the aqueous composition is drained out into waste water or adsorbed into a washing bath, thus making it difficult for the silicone compound to confer its effect sufficiently on textile products.

JP-A 2000-129570, JP-A 2000-129577, JP-A 2000-129578, JP-A 2000-239970, JP-A 2003-89978, JP-A 5-239774, JP-A 8-260356, JP-A 9-13272, JP-A 9-111662, JP-A 11-229266, JP-A 10-508911, JP-A 10-508912 and JP-A No. 5-44169 disclose techniques of simultaneously using a water-soluble polymer compound and a silicone compound; however, these techniques employ the water-soluble polymer compound as a starch-based or as a film-forming agent, and the water-soluble polymer compound is not used for the purpose of emulsifying the silicone compound. In addition, the silicone compound described in these references is emulsified with a surfactant, and thus the problem arising upon dilution with a large excess of water cannot be solved.

WO-A 00/73351 discloses a polysaccharide derivative modified with a long-chain alkyl group, and in the Examples of this reference, a technique of using a polysaccharide derivative in combination with a silicone compound is disclosed. However, this reference is directed to the stabilization of the silicone compound in solution and does not suggest the problem arising upon dilution of an aqueous composition containing the silicone compound with a large excess of water and naturally does not remind us of any improvement in the adsorption of the silicone compound.

Accordingly, the present invention provides a fiber-treating agent composition, which does not destroy emulsification even upon dilution of an aqueous composition containing a silicone compound with a large excess of water, improves the adsorption of the silicon compound onto the surface of an object such as textile products, and is excellent in storage stability.

The fiber-treating agent composition of the present invention does not destroy emulsification even upon dilution with a large excess of water, can be adsorbed into an object such as textile products thereby giving a silicone compound effectively to the object, and is excellent in storage stability.

[Component (a)]

The component (a) is a polymer compound containing constituent unit (a1) having 2 to 20 carbon atoms in total and having at least one group selected from a hydroxy group, a carboxylic acid group, a quaternary ammonium group, an amino group and an amide group, provided that constituent unit (a2) is excluded, and constituent unit (a2) having a C8 to C22 hydrocarbon group, in a (a1)/(a2) molar ratio in the range of 100/30 to 1000/1.

In the constituent unit (a1), the functional group selected from a hydroxy group, a carboxylic acid group, a quaternary ammonium group, an amino group and an amide group is a group having both an effect of giving water solubility to a polymer compound and an effect of being adsorbed into textile products, and the C8 to C22 hydrocarbon group in the constituent unit (a2) also has an effect of being adsorbed into liquid droplets of the silicone compound as component (b) thereby stabilizing the lubricant in an aqueous solution, and both the components play an important role in the present invention. The (a1)/(a2) molar ratio is that when the component (a) is compound (i) shown below, the (a1-1)/(a2-1) molar ratio is preferably 100/30 to 150/1, more preferably 100/20 to 100/1, particularly preferably 100/15 to 100/3. When the component (a) is compound (ii) shown below, the (a1-2)/(a2-2) molar ratio is preferably 1000/100 to 1000/1, more preferably 1000/80 to 750/1, particularly preferably 1000/50 to 1000/4. By regulating the ratio in these ranges, the component (a) can stably emulsify the silicone compound without destroying emulsification even upon dilution with a large excess of water, and can achieve an effect of accelerating adsorption onto the surface of an object such as textile products.

The component (a) in the present invention is at least one kind of polymer compound selected from the following (i) and (ii) and (iii):

(i) a polymer compound containing monomer unit (a1-1) represented by the formula (1) below and monomer unit (a2-1) represented by the formula (2) below, in a (a1-1)/(a2-1) molar ratio in the range of 100/30 to 150/1, wherein the ratio of the monomers (a1-1) and (a2-1) in total in all monomer units in the molecule is 50 to 100 mol %, (1)

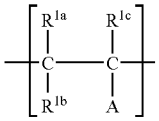

(2)

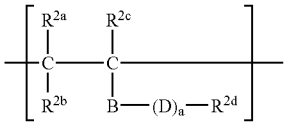

wherein $R^{1a}$ and $R^{2a}$ independently represent a hydrogen atom or a C1 to C3 alkyl group, $R^{1b}$ and $R^{2b}$ independently represent a group selected from a hydrogen atom and —$COOM^1$ wherein $M^1$ is a hydrogen atom, an alkali metal atom or an alkaline earth metal atom, $R^{1c}$ and $R^{2c}$ independently represent a group selected from a hydrogen atom, a C1 to C3 alkyl group and a hydroxy group, $R^{2d}$ represents a C8 to C22 hydrocarbon group, A represents —$COOM^2$, —OH, —$CON(R^{1d})(R^{1e})$, —COO—$R^{1f}$—$N^+(R^{1g})(R^{1h})(R^{1i}).X^-$, —COO—$R^{1f}$—$N(R^{1g})(R^{1h})$, —$CON(R^{1d})$—$R^{1f}$—$N^+(R^{1g})(R^{1h})(R^{1i}).X^-$, —$CON(R^{1d})$—$R^{1f}$—$N(R^{1g})(R^{1h})$, or a 5- or 6-member heterocyclic group having at least one amino or amide group in the ring, wherein $M^2$ is a hydrogen atom, an alkali metal atom or an alkaline earth metal atom, $R^{1d}$, $R^{1e}$, $R^{1g}$, $R^{1h}$ and $R^{1i}$ independently represent a hydrogen atom, a C1 to C3 alkyl group or a C1 to C3 hydroxyalkyl group, $R^{1f}$ represents a C1 to C5 alkylene group, $X^-$ represents an organic or inorganic anion, B is a group selected from —O—, —COO—, —OCO— or —$CONR^{2e}$— wherein $R^{2e}$ represents a hydrogen atom, a C1 to C3 alkyl group or a C1 to C3 hydroxyalkyl group, and D is bound to $R^{2d}$ via a group selected from an ether group, an ester group, a cationic group and an amide group and is at least one group selected from a C2 to C6 divalent hydrocarbon group, a polyoxyalkylene group having 1 to 300 moles of added oxyalkylene groups on the average and a polyglyceryl group having 1 to 10 moles of added glyceryl groups on the average, connecting B with $R^{2d}$, and a is a number of 0 or 1, and (ii) a polysaccharide derivative having (a1-2) a monosaccharide unit or a hydroxyalkylated (C1 to C3), carboxyalkylated (C1 to C3), or cationated monosaccharide unit and (a2-2) a monosaccharide unit or hydroxyalkylated (C1 to C3), carboxyalkylated (C1 to C3) or cationated monosaccharide unit wherein part or all of hydrogen atoms of hydroxy groups of the monosaccharide unit are substituted by groups represented by the formula (3) below, in a (a1-2)/(a2-2) molar ratio in the range of 1000/100 to 1000/1.

$$—R^{3a}—(OR^{3b})_b\text{-}E\text{-}R^{3c} \quad (3)$$

wherein $R^{3a}$ represents a C1 to C6 linear or branched divalent saturated hydrocarbon group which may be substituted with a hydroxy or oxo group, $R^{3b}$ represents a C1 to C6 linear or branched divalent saturated hydrocarbon group which may be substituted with a hydroxy or oxo group, b represents a number of 1 to 300, $R^{3b}$s whose number is b may be the same as or different from one another, E represents a group selected from —O—, —COO— and —OCO—, and $R^{3c}$ represents a C8 to C22 linear or branched hydrocarbon group which may be substituted with a hydroxy group.

(iii) a polysaccharide derivative wherein part or all of hydrogen atoms of hydroxy groups of the polysaccharide derivative are substituted by groups represented by the formula (3-1):

$$R^{3d}\text{-}(E^3)_{3p}\text{-}(R^{3e})_{3q}— \quad (3\text{-}1)$$

wherein $R^{3d}$ represents a C8 to C22 linear or branched hydrocarbon group which may be substituted with a hydroxy or oxo group; $R^{3e}$ represents a C1 to C6 linear or branched alkylene group which may be substituted with a hydroxy or oxo group, the total carbon number of $R^{3d}$ and $R^{3e}$ is 8 to 30; and $E^3$ represents a group selected from —O—, —COO— and —OCO—; and 3p and 3q are independently 0 or 1.

<Polymer Compound (i)>

The polymer compound (i) is a synthetic polymer compound synthesized from polymerizable unsaturated compounds by a ordinary method such as radical polymerization.

In the formula (1), each of $R^{1a}$ and $R^{1b}$ is preferably a hydrogen atom, and $R^{1c}$ is preferably a hydrogen atom or a methyl group. Each of $R^{1d}$, $R^{1e}$, $R^{1g}$, $R^{1h}$, and $R^{1i}$ is preferably a hydrogen atom, a methyl group, an ethyl group or a hydroxyethyl group, and particularly each of $R^{1e}$, $R^{1g}$, $R^{1h}$, and $R^{1i}$ is more preferably a methyl group, $R^{1d}$ is more preferably a hydrogen atom or a methyl group. $R^{1f}$ is preferably an ethylene group or a propylene group. The heterocyclic group includes a pyrrolidone group, pyridine group, piperidine group, piperazine group, imidazole group, caprolactam group etc., among which a pyrrolidone group is preferable. $X^-$ includes a chlorine ion, a sulfate ion, a C1 to C3 alkyl sulfate ion, a C1 to C12 fatty acid ion, and a benzene sulfonate ion which may be substituted with one to three C1 to C3 alkyl groups, among which a chlorine ion or an ethyl sulfate ion is preferable.

In the formula (2), each of $R^{2a}$ and $R^{2b}$ is preferably a hydrogen atom, and $R^{2c}$ is preferably a hydrogen atom or a methyl group. $R^{2d}$ is preferably a C8 to C20, more preferably C10 to C18, alkyl or alkenyl group, particularly preferably a C10 to C18 alkyl group. B is —COO— or —$CONR^{2e}$—, and $R^{2e}$ is preferably a hydrogen atom. D is a group for linking B and $R^{2d}$, and preferable examples of the specific structure of D, containing B and $R^{2d}$, can include —B—$[CH_2CH(OH)CH_2O]_c$—$(C_2H_4O)_d$—$(C_3H_6O)_e$—$R^{2d}$, —B—$C_nH_{2n}$—$N^+(CH3)_2(R^{2d}).X^-$, —B—$C_nH_{2n}$—COO—$R^{2d}$, and —B—$C_nH_{2n}$—CONH—$R^{2d}$. In this configuration, c is a number of 0 to 10, preferably a number of 0 to 5. d is a number of 0 to 300, preferably a number of 0 to 100, more preferably a number of 0 to 75, particularly preferably 0 to 50, and e is a number of 0 to 300, more preferably a number of 0 to 100. When c is 0, d+e is a number of 1 to 300, preferably 1 to 100, more preferably 1 to 50, and when c is a number of 1 to 10, preferably 1 to 5, more preferably 1 or 2, particularly preferably 1, d+e is a number of 0 to 300. n is a number of 2 to 6, preferably a number of 2 or 3. $X^-$ is the same anionic group as defined above.

In the constituent unit of the formula (2) in the polymer compound (i) in the present invention, a is preferably 1 from the viewpoint of achieving the effect of the present invention, and it is estimated that by arranging a spacer between a main chain of the polymer compound and the hydrophobic group $R^{2d}$ having affinity for the silicone compound, the stability of emulsion particles can be improved. In the present invention, the monomer unit of the formula (2) is more preferably one wherein D is —$(C_2H_4O)_d$— wherein d is 5 to 40.

The polymer compound (i) having the monomer units shown above can be obtained by copolymerizing a monomer (a1') derived from the monomer unit (a1-1) with a monomer (a2') derived from the monomer unit (a2-1) by a known method such as radical polymerization. The monomer unit (a2-1) can also be obtained by reacting $R^{2d}$-Z with a polymer compound wherein a monomer (a2") represented by $C(R^{2a})((R^{2b})=C(R^{2c})(Y)$ has been previously copolymerized with a monomer (a1') derived from the monomer unit (a1-1). Y and Z are reactive groups which react with each other to form —B-$(D)_a$-$R^{2d}$.

Specific examples of the monomer (a1') derived from the monomer unit (a1-1) include (meth) acrylic acid (or its alkali metal salt, alkaline earth metal salt), (anhydrous) maleic acid (or its alkali metal salt, alkaline earth metal salt), α-hydroxyacrylic acid (or its alkali metal salt, alkaline earth metal salt), (meth)acrylic acid dialkyl (C1 to C3) amide, (meth)acrylic acid dialkanol (C2 to C3) amide, (meth)acrylic acid monoalkanol (C2 to C3) amide, vinyl acetate (vinyl acetate is converted after polymerization into a vinyl alcohol skeleton by saponification), N-(meth)acryloyloxy alkyl (C1 to C3)—N,N-dialkyl (C1 to C3) amine, N-(meth)acryloyloxy alkyl (C1 to C3)—N,N-dialkanol (C1 to C3) amine, N-(meth)acryloyloxy alkyl (C1 to C3)—N,N,N-dialkyl (C1 to C3) ammonium salt (the salt is preferably a chlorine salt, methyl sulfate ester salt or ethyl sulfate ester salt), N-(meth)acryloyl amino alkyl (C1 to C3)—N,N-dialkyl (C1 to C3) amine, N-(meth)acryloyl amino alkyl (C1 to C3)—N,N-dialkanol (C1 to C3) amine, N-(meth)acryloyl amino alkyl (C1 to C3)—N,N,N-dialkyl (C1 to C3) ammonium salt (the salt is preferably a chlorine salt, methyl sulfate ester salt or ethyl sulfate ester salt), N-vinyl pyrrolidone, 2-vinyl pyridine, 3-vinyl pyridine, 3-vinyl piperidine, N-vinyl imidazole, N-vinyl-2-caprolactam etc.

The monomer (a2') derived from the monomer unit (a2-1) can include the following compounds:

$CH_2{=}CHCOO(C_2H_4O)_d{-}R^{2d}$ $CH_2{=}C(CH_3)COO(C_2H_4O)_d{-}R^{2d}$ $CH_2{=}CHCOOC_2H_4N^+(CH_3)_2(R^{2d}).X^-$ $CH_2{=}C(CH_3)COO\ C_2H_4N^+(CH_3)_2(R^{2d}).X^-$ $CH_2{=}CHCONHC_3H_6N^+(CH_3)_2(R^{2d}).X^-$ $CH_2{=}C(CH_3)CONHC_3H_6N^+(CH_3)_2(R^{2d}).X^-$ $CH_2{=}CHCOOR^{2d}$ $CH_2{=}C(CH_3)COOR^{2d}$ wherein $R^{2d}$, d and $X^-$ have the same meanings as defined above.

The monomer unit (a2-1) can also be obtained by reacting a glycidyl ether compound represented by the following formula (4):

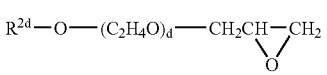

(4)

wherein $R^{2d}$ and d have the same meanings as defined above, with OH of a vinyl alcohol unit obtained by copolymerizing the monomer (a1') with vinyl acetate and then saponifying the resulting product. Alternatively, the monomer unit (a2-1) can also be obtained by copolymerizing the monomer (a1') with a polyoxyethylene vinyl ether having 1 to 300 moles, preferably 1 to 100 moles and more preferably 1 to 50 moles, of added oxyethylene groups on the average, and then reacting the resulting product with a compound represented by the following formula (5):

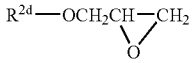

(5)

wherein $R^{2d}$ has the same meaning as defined above. Alternatively, the monomer unit (a2-1) can also be obtained by copolymerizing the monomer (a1') with N-(meth)acryloyloxyethyl-N,N-dialkyl (C1 to C3) amine and/or N-(meth) acryloylaminopropyl-N,N-dialkyl (C1 to C3) amine and then subjecting the product to quaternarization reaction with an alkylating agent such as a compound represented by the formula $R^{2d}$—Cl wherein $R^{2d}$ has the same meaning as defined above.

The polymer compound (i) is a polymer compound containing, in its molecule, the monomer units (a1-1) and (a2-1) in a total amount of preferably 50 to 100 mol %, more preferably 55 to 100 mol %, particularly preferably 60 to 100 mol %, and can also be copolymerized with other monomers copolymerizable with the monomer (a1') and the monomer (a2') or the monomer (a2"). The other copolymerizable monomers can include compounds such as ethylene, propylene, N-butylene, isobutylene, N-pentene, isoprene, 2-methyl-1-butene, N-hexene, 2-methyl-1-pentene, 3-methyl-1-pentene, 4-methyl-1-pentene, 2-ethyl-1-butene, styrene, vinyl toluene, α-methylstyrene etc.

The polymer compound (i) may be obtained by any polymerization methods among which a radical polymerization method is particularly preferable, and radical polymerization can be carried out in a bulk, solution or emulsion system. Radical polymerization may be initiated by heating or with existing radical initiators including azo-based initiators such as 2,2'-azobis(2-amidinopropane)dihydrochloride, 2,2'-azobis(N,N-dimethyleneisobutylamidine) dihydrochloride, etc., organic peroxides such as hydrogen peroxide, benzoyl peroxide, t-butyl hydroperoxide, cumene hydroperoxide, methyl ethyl ketone peroxide, perbenzoic acid, etc., persulfates such as sodium persulfate, potassium persulfate, ammonium persulfate, etc., redox initiators such as hydrogen peroxide-$Fe^{3+}$, etc., or by irradiation with light in the presence or absence of a photosensitizer, or by irradiation with radiations.

The weight-average molecular weight of the polymer compound (i) is preferably 2,000 to 200,000, more preferably 3,000 to 150,000, particularly preferably 4,000 to 120,000. The weight-average molecular weight can be determined by gel permeation chromatography with polyethylene glycol as standard.

<Polymer Compound (ii)>

In the polymer compound (ii), the monosaccharide unit constituting the monosaccharide unit (a1-2) can include glucose, mannose, fructose, galactose, xylose etc., among which glucose is more preferable. For the purpose of conferring water solubility on the polymer compound, hydroxyalkylated (C1 to C3), preferably hydroxyethylated, carboxyalkylated (C1 to C3), preferably carboxymethylated or cationated monosaccharide units are preferable.

In the polymer compound (ii), the monosaccharide unit constituting the monosaccharide unit (a2-2) can include glucose, mannose, fructose, galactose, xylose etc., among which glucose is more preferable. For the purpose of conferring water solubility on the polymer compound, hydroxyalkylated (C1 to C3), preferably hydroxyethylated, carboxyalkylated (C1 to C3), preferably carboxymethylated or cationated monosaccharide units are preferable.

The monosaccharide unit (a2-2) is one wherein part or all of hydrogen atoms of hydroxy groups of the monosaccharide unit (a1-2) are substituted by groups represented by the formula (3) above.

In the formula (3), $R^{3a}$ preferably represents a C2 or C3 alkylene group which may be substituted with a hydroxy group, $R^{3b}$ preferably represents a C2 or C3 alkylene group, more preferably an ethylene group, b is preferably 3 to 120, more preferably 5 to 60, even more preferably 8 to 60, even more preferably 8 to 30, and $R^{3b}$s whose number is b may be the same as or different from one another. E represents an ether linkage (—O—) or an ester linkage (—COO— or —OCO—), preferably an ether linkage. $R^{3c}$ is preferably a C8 to C20, more preferably C8 to C18, even more preferably C10 to C18, even more preferably C12 to C18, linear or branched hydrocarbon group, further preferably a linear C12 to C18 alkyl group. Specifically, an octyl group, decyl group, dodecyl group, tetradecyl group, hexadecyl group, octadecyl group, isostearyl group, hexyldecyl group, octyldecyl group etc. are preferable.

In the present invention, the polymer compound (ii) is a polysaccharide derivative wherein the (a1-2)/(a2-2) molar ratio is preferably 1000/100 to 1000/1, preferably 1000/80 to 750/1, more preferably 1000/50 to 1000/4. Such a polysaccharide derivative is obtained by reacting a compound represented by the following formula (6):

$$G\text{-}(OR^{3b})_b\text{-}E\text{-}R^{3c} \quad (6)$$

wherein G represents a group which reacts with a hydroxy group to form an ether linkage or an ester linkage, and $R^{3b}$, b, E and $R^{3c}$ have the same meanings as defined above, with a hydroxy group of a polysaccharide or a hydroxyalkylated, carboxyalkylated or cationated polysaccharide, in such a range that the resulting product has the (a1-2)/(a2-2) molar ratio described above.

The polysaccharide used in the polymer compound (ii) includes polysaccharides such as cellulose, guar gum, starch, pullulan, dextran, fructan, mannan, agar, carrageenan, chitin, chitosan, pectin, alginic acid, hyaluronic acid etc., and derivatives thereof substituted with a methyl group, an ethyl group, a hydroxyethyl group, a hydroxypropyl group, etc. The constituent monosaccharide residue can be substituted with one or a plurality of these substituent groups. Examples of such polysaccharide derivatives include hydroxyethyl cellulose, hydroxyethylethyl cellulose, hydroxyethyl guar gum, hydroxyethyl starch, methyl cellulose, methyl guar gum, methyl starch, ethyl cellulose, ethyl guar gum, ethyl starch, hydroxypropyl cellulose, hydroxypropyl guar gum, hydroxypropyl starch, hydroxyethylmethyl cellulose, hydroxyethylmethyl guar gum, hydroxyethylmethyl starch, hydroxypropylmethyl cellulose, hydroxypropylmethyl guar gum, hydroxypropylmethyl starch etc. Among these polysaccharides, cellulose, starch, hydroxyethyl cellulose, methyl cellulose, ethyl cellulose and hydroxypropyl cellulose are preferable, among which hydroxyethyl cellulose is particularly preferable. The substituent groups on the polysaccharide derivatives can be further substituted with hydroxy groups of hydroxyethyl groups and hydroxypropyl groups, to form for example polyoxyethylene chains etc. thereby attaining a substitution degree of greater than 3.0 per constituent monosaccharide residue, and the degree of substitution per constituent monosaccharide residue is preferably 0.1 to 10.0, more preferably 0.5 to 5.0. The weight-average molecular weight of these polysaccharides is preferably in the range of 10,000 to 10,000,000, more preferably 100,000 to 5,000,000, particularly preferably 100,000 to 750,000.

The compounds represented by the formula (6) are preferably the following compounds.

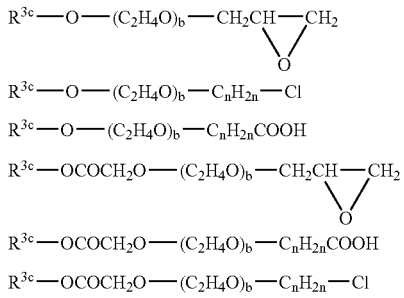

wherein b, $R^{3c}$ and n have the same meanings as defined above.

When the polysaccharide is a carboxyalkylated polysaccharide, it is also possible to use:

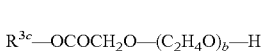

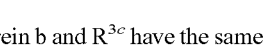

wherein b and $R^{3c}$ have the same meanings as defined above.

In the present invention, the compound represented by the formula (6) is more preferably a compound represented by the following formula (6-1):

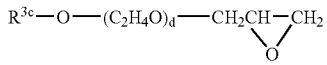

(6-1)

wherein b and $R^{3c}$ have the same meanings as defined above.

When the polysaccharide is a hydroxyalkylated polysaccharide, the degree of introduction of hydroxyalkyl groups (the number of hydroxyalkyl groups in the monosaccharide unit) is preferably 0.01 to 3.5, more preferably 0.01 to 3.0; when the polysaccharide is a carboxyalkylated polysaccharide, the degree of introduction of carboxyalkyl groups (the number of carboxyalkyl groups in the monosaccharide unit) is preferably 0.01 to 3.0, more preferably 0.1 to 2.5; and when the polysaccharide is a cationated polysaccharide, the degree of introduction of cationic groups is preferably 0.01 to 3.0, more preferably 0.1 to 2.5.

The polymer compound (ii) in the present invention is more preferably a compound obtained by reacting, within the range of the above (a1-2)/(a2-2) molar ratio, the compound represented by the formula (6-1) above with hydroxyethyl cellulose wherein the degree of introduction of hydroxyethyl groups is 0.01 to 3.5.

The polymer compound (ii) of the present invention can be produced by a method described in WO-A 00/73351.

<Polymer Compound (iii)>

In the polymer compound (iii), the polysaccharide may be a polysaccharide such as cellulose, guar gum, starch, pullulan, dextran, fructan, mannan, agar, carrageenan, chitin, chitosan, pectin, alginic acid or hyaluronic acid or a derivatives of such saccharide, substituted with an alkyl group such as a methyl group or an ethyl group, a hydroxyalkyl group such as a hydroxyethyl group or a hydroxypropyl group, a carboxymethyl group, etc. The constituent monosaccharide residue may be substituted with one or a plurality of these substituent groups.

Examples of such polysaccharide derivatives include hydroxyalkyl (C1 to C3) cellulose, alkyl (C1 to C3) cellulose, hydroxyalkyl (C1 to C3) starch, alkyl (C1 to C3) starch, carboxymethylated starch, htdroxyalkyl (C1 to C3) guar gum, alkyl (C1 to C3) guar gum etc.

Among the polysaccharides, cellulose, starch, hydroxyalkyl (C1 to C3) cellulose and alkyl (C1 to C3) cellulose are preferable. Hydroxyethyl cellulose is more preferable.

In the polysaccharide derivatives, the degree of substitution of alkyl group, hydroxyalkyl group, carboxymethyl group per one constituent monosaccharide residue is preferably 0.01 to 3.5, more preferably 0.1 to 3.0, even more preferably 1 to 3, even more preferably 1.5 to 2.8.

The substituent group on the polysaccharide derivative may be a hydroxy group of hydroxyethyl group or hydroxypropyl group further substituted with, for example, a polyoxyethylene chain, thereby to obtain a substitution degree of greater than 3.0 per one constituent monosaccharide residue. The degree of substitution per one constituent monosaccharide residue is preferably 0.1 to 10.0, more preferably 0.5 to 5.0.

The weight-average molecular weight of the polysaccharide is preferably in the range of 1,000 to 10,000,000, more preferably 2,000 to 5,000,000, even more preferably 3,000 to 2,000,000, even more preferably 4000 to 1,000,000.

In the group represented by the formula (3-1) substituting part or all of hydrogen atoms of hydroxy groups of the polysaccharide, $R^{3d}$ is preferably a C8 to C20, more preferably C8 to C18, even more preferably C10 to C18, linear or branched hydrocarbon group. A linear alkyl group is even more preferable. An example of $R^{3d}$ is preferably octyl group, decyl group, dodecyl group, tetradecyl group, hexadecyl group, octadecyl group, isostearyl group, hexyldecyl group, octyldecyl group etc.

$R^{3e}$ may be a C1 to C3 alkylene group which may be preferably substituted with hydroxyl group and may be more preferably a C2 or C3 alkylene group which may be substituted with hydroxyl group.

The group represented by the formula (3-1) is preferably groups represented by formulae (3-1-1) to (3-1-5), respectively.

| | |
|---|---|
| $R^{3d\text{-}1}$—O—$CH_2CH(OH)CH_2$— | (3-1-1) |
| $R^{3d\text{-}2}$—$CH(OH)CH_2$— | (3-1-2) |
| $R^{3d\text{-}3}$— | (3-1-3) |
| $R^{3d\text{-}4}$—CO— | (3-1-4) |
| $R^{3d\text{-}4}$—OCO—$CH_2$— | (3-1-5) |

wherein $R^{3d\text{-}1}$ is a C8 to C22 linear or branched alkyl group, $R^{3d\text{-}2}$ is a C8 to C22 linear or branched alkyl group, $R^{3d\text{-}3}$ is a C8 to C22 linear or branched alkyl group which may be substituted with a hydroxy group, $R^{3d\text{-}4}$ is a C8 to C22 linear or branched alkyl group which may be substituted with a hydroxy group, $R^{3d\text{-}5}$ is a C8 to C22 linear or branched alkyl group, $R^{3d\text{-}5}$ is a C8 to C22 linear or branched alkylene group.

In the polymer compound (iii), a substitution degree of the group represented by formula (3-1) in the polysaccharide derivative is preferably 0.001 to 0.2, more preferably 0.001 to 0.1, even more preferably 0.002 to 0.05, even more preferably 0.003 to 0.02, per one constituent monosaccharide residue.

The polymer compound (iii) can be obtained by reacting a polysaccharide or a hydroxyalkylated, carboxyalkylated or cationated polysaccharide with a hydrophobic-making agent selected from a compound of glycidyl ether, epoxide, halide or halohydorine, having a C8 to C22 linear or branched alkyl group and a compound of ester, acid halide or carboxylic anhydride, having a C8 to C22 linear or branched, saturated or unsaturated acyl group.

The used hydrophobic-making agent may be compounds represented by the following formulas (3'-1-1) to (3'-1-5), respectively.

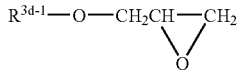
(3'-1-1)

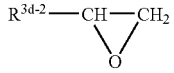
(3'-1-2)

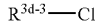
(3'-1-3)

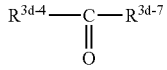
(3'-1-4)

(3'-1-5)

wherein $R^{3d\text{-}1}$, $R^{3d\text{-}2}$, $R^{3d\text{-}3}$, $R^{3d\text{-}4}$, $R^{3d\text{-}5}$ and $R^{3d\text{-}6}$ have the same meaning as above; $R^{3d\text{-}7}$ is Cl, $OR^{3d\text{-}8}$($R^{3d\text{-}8}$ is a C1 to C4 alkyl group) or OH.

When the polysaccharide is a carboxyalkylated saccharide, $R^{3d\text{-}3}$—OH, $R^{3d\text{-}4}$—$OCOCH_2OH$ (wherein $R^{3d\text{-}3}$ and $R^{3d\text{-}4}$ are the same as above.) can be used.

Among the hydrophobic making agent, glycidyl ether, epoxide, halide and acylhalide are more preferable. The hydrophobic making agent may be used alone or in combination of two or more.

[Component (b)]

The component (b) in the present invention is a polyether-modified silicone having an HLB value of larger than zero to 7 or smaller.

The HLB of the component (b) is preferably larger than zero to 5 or smaller, more preferably larger than zero to 3 or smaller. The component (b) includes a compound represented by the following formula (7) (hereinafter, referred to as component (b1)) and a compound represented by the following formula (8) (hereinafter, referred to as component (b2)).

(7)

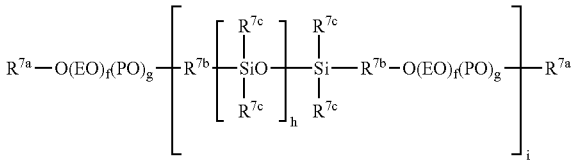

wherein $R^{7a}$ represents a hydrogen atom or a monovalent hydrocarbon group, preferably a hydrogen atom or a methyl group; $R^{7b}$ represents a C1 to C20 divalent hydrocarbon group, preferably a C3 to C6 divalent hydrocarbon group, more preferably a C3 to C6 alkylene group; $R^{7c}$ represents a C1 to C3 alkyl group, a hydrogen atom or a hydroxy group, preferably a methyl group; EO is an oxyethylene group and PO is an oxypropylene group; f represents the number of oxyethylene groups added on average, g is the number of oxypropylene groups added on average, h is an average number of 0 or more, i is an average number of 0 or more, and although these values are selected such that the viscosity of the polyether-modified silicone at 25° C. becomes preferably 2 to 1,000,000 $mm^2/s$, more preferably 50 to 500,000 $mm^2/s$, particularly preferably 150 to 100,000 $mm^2/s$, each of f and g is preferably a number of 0 to 60, more preferably 0 to 35; h is an average number of 1 to 500; i is an average number of 1 to 100; and a plurality of $R^{7a}$, $R^{7b}$, $R^{7c}$, f, g and h may be the same as or different from one another.

(8)

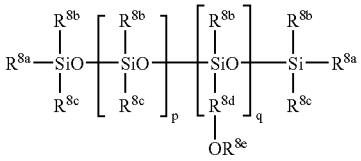

wherein $R^{8a}$ is selected from a C1 to 3 alkyl or alkoxy group, a hydrogen atom and a hydroxy group and is particularly preferably a methyl group; $R^{8b}$ and $R^{8c}$ are selected independently from a C1 to C3 alkyl group, a hydrogen atom and a hydroxy group and are particularly preferably methyl groups; p and q each represent an average polymerization degree, and these values are selected such that the viscosity of the polyether-modified silicone at 25° C. becomes preferably 2 to 1,000,000 $mm^2/s$, more preferably 50 to 500,000 $mm^2/s$, particularly preferably 150 to 100,000 $mm^2/s$; p is 10 to 10,000, preferably 10 to 1,000 and q is 1 to 1,000, preferably 3to 100; $R^{8d}$ is a C1 to C3 alkylene group, and $R^{8e}$ is a group represented by $-(EO)_j-(PO)_k-L$ wherein L is a C1 to C3 alkyl group or a hydrogen atom, EO is an oxyethylene group, PO is an oxypropylene group; and j and k each represent the number of groups added on average, and the number of groups added in total is 1 to 100, preferably 2 to 100, particularly preferably 2 to 50.

The HLB value of the component (b1) is a value determined from cloud point A determined in the following manner, according to the following equation:

$$HLB=\text{cloud point } A\times 0.89+1.11$$

<Method of Measuring the Cloud Point>

The cloud point A is measured in the following manner according to a known method ["Kaimenkasseizai Binran (Surfactant Handbook)", pp. 324-325 published on Jul. 5, 1960 by Sangyo Tosho Co., Ltd.].

2.5 g anhydrous polyol-modified silicone is weighed out and adjusted to a volume of 25 ml (in a 25-ml measuring flask) with 98% ethanol. Then, the resulting solution is pipetted via a 5-ml pipette into a 50-ml beaker, then kept at a low temperature of 25° C. under stirring (with a magnetic stirrer) and measured with 2% aqueous phenol solution through a 25-ml burette. The end point is a point at which the solution becomes cloudy, and the volume (ml) of 2% aqueous phenol solution necessary for this titration is determined as cloud point A.

The HLB value of the component (b2) is a value determined according to the following equation:

$$HLB=[\text{amount (wt \%) of (EO)}+\text{amount (wt \%) of (PO)}]\div 5$$

Specific examples of the component (b1) used in the present invention can include FZ-2203, FZ-2206, FZ-2207, FZ-2222, F1-009-01, F1-009-05, F1-009-09, F1-009-11 and F1-009-13 manufactured by Nihonyunica Corporation.

Specific examples of the component (b2) used in the present invention can include SH3772M and SH3775M manufactured by Dow Corning Toray Silicone Co., Ltd., KF6012, KF6016 and KF6017 manufactured by Shin-Etsu Chemical Co., Ltd., and TSF4445 and TSF4446 manufactured by Toshiba Silicone Co., Ltd.

[Other Components]

The oil-in-water-type emulsion of the present invention contains the components (a) and (b) as essential ingredients, and for the purpose of improving the stability of the emulsion and for the purpose of accelerating the adsorption of a lubricant onto the surface of an object, a surfactant can be used as component (d). The surfactant that can be used can include a nonionic surfactant, a cationic surfactant, an anionic surfactant and an amphoteric surfactant, and from the viewpoint of emulsion stability, the surfactant is preferably the nonionic surfactant (d1), which is preferably used in combination with the cationic surfactant (d2), from the viewpoint of accelerating adsorption onto the surface of an object.

From the viewpoint of emulsion stability, the nonionic surfactant (d1) is preferably a compound represented by the following formula (10):

$$R^{10a}\text{-J-}[(R^{10b}\text{—O})_w\text{—}R^{10c}]_x \qquad (10)$$

wherein $R^{10a}$ is a C8 to C32, preferably C10 to C28, more preferably C10 to C24, particularly preferably C10 to C18, alkyl or alkenyl group, and $R^{10b}$ is a C2 or C3 alkylene group; $R^{10c}$ is a hydrogen atom or a C1 to C3 alkyl group; J is a linking group selected from —O—, —COO—, —CON< and —N<; when J is —O— or —COO—, x is 1; when J is —CON< or —N<, x is 2; w is a number-average value of 1 to 150, preferably 2 to 80, more preferably 4 to 50; and a plurality of $R^{10b}$s and $R^{10c}$s may be the same as or different from one another.

In the formula (10), $R^{10a}$ is more preferably a C10 to C18 alkyl group, $R^{10b}$ is more preferably an ethylene group, and $R^{10c}$ is more preferably a hydrogen atom. J is —O— or —COO—, particularly preferably —O—.

Particularly the nonionic surfactant (d1) is more preferably a compound represented by the following formula (10-1):

$$R^{10a}\text{—O—}(C_2H_4O)_w\text{—H} \qquad (10\text{-}1)$$

wherein $R^{10a}$ and w have the same meanings as defined above.

From the viewpoint of accelerating the adsorption of a lubricant onto the surface of an object, the cationic surfactant (d2) is preferably a compound represented by the following formula (11):

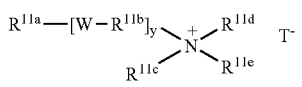

(11)

wherein $R^{11a}$ is a C11 to C24 hydrocarbon group, W is a group selected from —COO— and —CONH—, $R^{11b}$ is a C2 or C3 alkylene group; y is a number of 0 or 1; $R^{11c}$ is a C1 to C3 alkyl group, a C2 or C3 hydroxyalkyl group, or $R^{11a}$—[W—$R^{11b}$]$_y$—; $R^{11d}$ is a C1 to C3 alkyl group, a C2 or C3 hydroxyalkyl group, $R^{11e}$ is a C1 to C3 alkyl group, a C2 or C3 hydroxyalkyl group or a hydrogen atom; and $T^-$ is an organic or inorganic anion.

In the compound represented by the formula (11), $R^{11a}$ is preferably a C14 to C18 alkyl or alkenyl group, and y is the number of 1. The cationic surfactant (d2) is preferably a mixture of the compound (d2-2) wherein $R^{11c}$ is $R^{11a}$—[W—$R^{11b}$]$_y$— and the compound (d2-1) wherein $R^{11c}$ is a methyl group or a hydroxyethyl group, wherein the (d2-2)/(d2-1) ratio by mass is preferably 100/1 to 100/10, more preferably 100/2 to 100/6, from the viewpoint of accelerating the adsorption of a lubricant. $R^{11d}$ is preferably a methyl group or a hydroxyethyl group, and $R^{11e}$ is preferably a hydrogen atom or a methyl group. $T^-$ is preferably a halogen ion (preferably a chlorine ion), a C1 to C3 alkyl sulfate ion, a C1 to C12 fatty acid ion, or a benzene sulfonate ion which may be substituted with a C1 to C3 alkyl group.

For the purpose of regulating the rheology of the composition and from the viewpoint of emulsion stability, a water-soluble solvent (e) is preferably simultaneously used in the present invention. Preferable examples of the water-soluble solvent include ethanol, propanol, isopropanol, ethylene glycol, propylene glycol, glycerin and 1,3-butane diol, among which glycerin, ethylene glycol, propylene glycol and 1,3-butane diol are particularly preferable.

In the present invention, usual additives used in a fiber-treating agent, for example, ingredients such as a perfume, a preservative, a dye, a pigment, a viscosity regulator, an inorganic salt, and a hydrotropic agent can be used if necessary.

[Fiber-Treating Composition]

The content of the component (a) in the fiber-treating agent composition of the present invention is preferably 0.01 to 10 mass %, more preferably 0.05 to 8.0 mass %, particularly preferably 0.1 to 5.0 mass %. The content of the component (b) is preferably 0.1 to 50 mass %, more preferably 1.0 to 50 mass %, particularly preferably 3.0 to 45 mass %. The compounding ratio of the component (a) to the component (b), that is, the component (a)/component (b) (ratio by mass), is 9/100to 30/100, and when the component (a) is the compound (i), the ratio is preferably 10/100 to 28/100, more preferably 11/100 to 26/100, particularly preferably 12/100 to 25/100. On the other hand, when the component (a) is the compound (ii), the ratio is preferably 10/100 to 25/100, more preferably 10/100 to 20/100, particularly preferably 10/100 to 17/100. The content of water as the component (c) in the fiber-treating agent composition of the present invention is preferably 40 to 95 mass %, more preferably 50 to 90 mass %, particularly preferably 60 to 90 mass %.

When the fiber-treating agent composition of the present invention is used, the composition is used for treating clothes in such an amount that the amount of the silicone compound as the component (b) becomes 0.05 to 5.0 mass %, more preferably 0.07 to 4.0 mass %, particularly preferably 0.1 to 3.0 mass %, based on the clothes. Specifically, the fiber-treating agent composition of the present invention is used in treatment by adding it in an amount (mass %) within the above range to washing or rinsing water containing textile products, whereby the component (b) can be efficiently adsorbed into fibers. The fiber-treating agent composition of the present invention is added preferably in an amount (mass %) within the above range under the condition where the mass ratio of treated textile products to water (bath ratio=mass of water/mass of textile products) is 5 to 30, preferably 8 to 20.

In the fiber-treating agent composition of the present invention, the component (d1), though being an arbitrary component, is preferably used for the purpose of improving the stability of the composition, but should be carefully used because its incorporation in a large amount may adversely affect the effect of the invention. The content of the component (d1) in the composition of the present invention is preferably 0.1 to 20 mass %, more preferably 1 to 15 mass %, particularly preferably 2 to 10 mass %. The [component (b)+ component (a)]/component (d1) (ratio by mass) is preferably 1/1 to 50/1, more preferably 3/1 to 30/1, particularly preferably 7/1 to 20/1. The component (d2) is preferably simultaneously used for the purpose of improving the adsorption of the component (b) onto the surface of an object, but the incorporation of the component (d2) in a large amount, similar to the component (d1), may adversely affect the effect of the invention. The content of the component (d2) in the fiber-treating agent composition of the present invention is preferably 0 to 20 mass %, more preferably 1 to 15 mass %, particularly preferably 2 to 10 mass %. The [component (b)+ component (a)]/component (d2) (ratio by mass) is preferably 1/5 to 80/1, more preferably 1/1 to 60/1, particularly preferably 5/1 to 40/1. The content of the component (e) in the fiber-treating agent composition of the present invention is preferably 0.5 to 30 mass %, more preferably 1 to 20 mass %, particularly preferably 4 to 15 mass %, from the viewpoint of shelf stability.

The pH value of the fiber-treating agent composition of the invention at 20° C. is adjusted preferably to 2 to 8, preferably 4 to 7.5, from the viewpoint of stability. As the pH adjusting agent, acids for example inorganic acids such as hydrochloric acid and sulfuric acid or organic acids such as citric acid, succinic acid, malic acid, fumaric acid, tartaric acid, malonic acid and maleic acid, and alkalis for example sodium hydroxide, potassium hydroxide, ammonia or derivatives thereof, salts of amines such as monoethanolamine, diethanolamine and triethanolamine, and sodium carbonate and potassium carbonate are used preferably alone or as a mixture thereof, and particularly, an acid selected from hydrochloric acid, sulfuric acid and citric acid and an alkali selected from sodium hydroxide and potassium hydroxide are preferably used.

From the viewpoint of easy handling and emulsion stability, the viscosity of the fiber-treating agent composition of the invention at 20° C. is preferably 2 to 300 mPa·s, more preferably 5 to 200 mPa·s, particularly preferably 10 to 150 mPa·s. For regulating the viscosity in these ranges, the component (e) or a usual viscosity regulator is used.

[Method of Producing the Fiber-Treating Agent Composition]

The oil-in-water (O/W) emulsion of the present invention can be obtained by adding water (component (c)) to the composition (A) under stirring. Water used as the component (c)

can be distilled water or deionized water from which contaminants (for example, heavy metals) present in a very small amount were removed. Sterile water sterilized with chlorine etc. can also be used. The composition of the present invention is preferably in the form of an O/W type emulsion in order to accelerate the adsorption of the component (b) onto the surface of an object. The composition of the invention is more preferably an O/W emulsified composition in which capsular particles having the component (a) as outer shell containing the component (b) therein are dispersed. This is due to sufficient emulsification considered attributable to the interaction of hydroxyl groups in the component (a) with an object to be treated, or to the interaction of alkyl groups in the component (a) with an object to be treated.

Although the method of producing the composition of the invention is not particularly limited, the composition can be produced according to the following production method.

The component (a), if necessary the components (d1), (d2) and (e), are added to 15% (of the necessary amount) of the component (c) , then heated, stirred at 80° C. and then cooled to 25° C. (this solution is referred to as (F)). Then, if necessary, the component (d1) and (d2) are added thereto under stirring and left under stirring. Thereafter, the component (b) is added slowly. When the component (b) is solid or does not fluidize at ordinary temperatures, the component (b) is added preferably after heating to a melting point thereof or to a flow point thereof or higher. In this case, the solution (F) is also desirably heated to the melting point of the component (b) or to the flow point thereof or higher. After addition, the blend is further stirred, and then the temperature of the blend is increased to 60° C. or to the melting point of the component (b) or to the flow point thereof or higher, and the blend is further stirred to give a composition. The composition is cooled if necessary to about 40° C., and the remainder of the component (c) is added slowly to the composition obtained by the method described above, and then stirred. If necessary, the pH is regulated, and then the temperature of the blend is decreased slowly to ordinary temperatures to give the oil-in-water-type emulsion of the present invention. In the production method described above, part of the component (b) may be added together with the component (a).

In the present invention, it is preferable that the solution (F) is regulated at 20 to 75° C., preferably 30 to 60° C., and water as the component (c) at 20 to 90° C., preferably 30 to 70° C., is mixed therewith. The components (d1) and (d2) may be added previously to the solution (F) or may be dissolved previously in the component (e), or may be added after the solution (F) is mixed with the component (c).

According to this method, an oil-in-water-type emulsion containing capsular particles having a particle diameter of 0.1 to 50 μm containing the component (a) as the outer shell in which the component (b) is included can be obtained.

In the present invention, there can be provided a fiber-treating agent composition containing an oil-in-water-type emulsion in which a silicone compound is included, and according to the present invention, the silicone compound can be efficiently adsorbed onto the surface of an object, without destroying emulsification upon dilution.

EXAMPLES

The compounding ingredients used in the Examples are collectively shown below. The term "%" in the Examples refers to mass % unless otherwise specified.

<Compounding Ingredients>

Component (a)

(a-1): A vinyl pyrrolidone/dimethylaminopropyl methacrylate/dimethylaminopropyl methacrylate lauryl chloride quaternary ammonium salt copolymer (Styleeze W-20, (a1-1)/(a2-1)=90/10 (molar ratio) manufactured by ISP Japan).

(a-2): The polymer compound (a-2) manufactured in Synthesis Example 1.

(a-3): The polysaccharide derivative (a-3) produced in Synthesis Example 2.

(a-4): The polysaccharide derivative (a-4) produced in Synthesis Example 3.

(a-5): The polysaccharide derivative (a-5) produced in Synthesis Example 4.

(a-6): The polysaccharide derivative (a-6) obtained in Syntheses Example 5.

(a-7): The polysaccharide derivative (a-7) obtained in Synthesis Example 6.

Comparative Compounds (a'-1): Sodium polyacrylate (Acrylic DL-384, weight-average molecular weight 8000, manufactured by Nippon Shokubai Co., Ltd.).

(a'-2): A nonionic surface having 12 moles on average of ethylene oxide added to 1 mole of lauryl alcohol.

Component (b)

(b-1): SM-3775M (polyether-modified silicone, HLB value of 5, manufactured by Dow Corning Toray Silicone Co., Ltd.). (b-2): FZ-2109 (polyether-modified silicone, HLB value of 1, manufactured by Dow Corning Toray Silicone Co., Ltd.).

(b-3) Polyether-modified silicone (HLB value: 1) represented by the following formula (8-1):

(8-1)

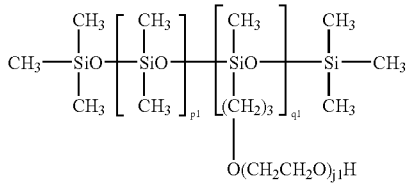

wherein $p_1$ is a number of 450 to 550, $q_1$ is a number of 5 to 15, and $j_1$ is a number of 2 to 5.

(b-4) Polyether-modified silicone (HLB value: 1) represented by the following formula (8-2):

(8-2)

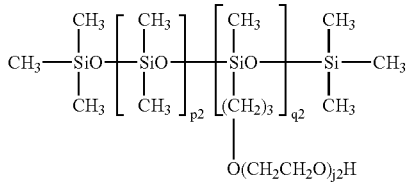

wherein $P_2$ is a number of 380 to 480, $q_2$ is a number of 5 to 15, and $j_2$ is a number of 2 to 5.

(b-5) Polyether-modified silicone (HLB value: 1) represented by the following formula (8-3):

(8-3)

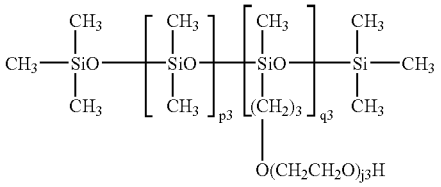

wherein $p_3$ is a number of 340 to 440, $q_3$ is a number of 5 to 15, and $j_3$ is a number of 2 to 5.

Component (b') (comparative compound for the component (b)) (b'-1): KF96A-5,000 (methyl polysiloxane manufactured by Shin-Etsu Chemical Co., Ltd.).

Component (c): Water.

Component (d)

(d1-1): Polyoxyethylene (EO=21) lauryl ether.

(d2-2-1): N-stearoylaminopropyl-N-stearoyloxyethyl-N,N-dimethyl ammonium chloride.

(d2-1-1): N-stearoylaminopropyl-N-2-hydroxyethyl-N,N-dimethyl ammonium chloride.

Component (e)

(e-1): Glycerin.

Synthesis Example 1

Synthesis Example of Polymer Compound (a-2)

94.2 g of N,N-dimethyl acrylamide, 51.7 g of ALE-900 (lauroxy polyethylene glycol (EO=18) monoacrylate, manufactured by NOF Corporation) and 200 g ethanol were mixed with one another. The system was degassed by blowing a nitrogen gas into the resulting solution (20 ml/min., 1 hour) and then heated to 60° C. Thereafter, 82.8 g of (3%) solution of V-65 (polymerization initiator, manufactured by Wako Pure Chemical Industries, Ltd.) in ethanol was added dropwise to the solution kept at 60° C. After dropwise addition was finished, the mixture was aged at 60° C. for 12 hours. After the reaction was finished, the resulting reaction mixture was added drop wise to 2 kg diisopropyl ether. The resulting white solids were separated by filtration and washed with diisopropyl ether (500 g×twice). After drying under reduced pressure, 115 g polymer compound (a-2) represented by formula (14) below was obtained. The degree of introduction [m2/(m1+m2)] of lauroxy polyethylene glycol monoacrylate into the resulting compound (a-2), as determined by NMR, was 0.054. The weight-average molecular weight was 65,000.

(14)

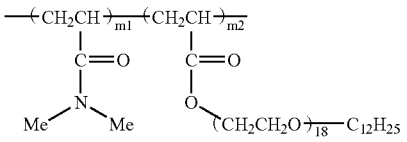

Synthesis Example 2

Synthesis Example of Polysaccharide Derivative (a-3)

160 g of hydroxyethyl cellulose having a weight-average molecular weight of 200,000 wherein the substitution degree of hydroxyethyl groups was 2.5 (SE400, manufactured by Daicel Chemical Industries, Ltd.), 850 g of isopropyl alcohol with a water content of 80 %, and 9.8 g of 48% aqueous sodium hydroxide were mixed to prepare a slurry which was then stirred for 30 minutes at room temperature in a nitrogen atmosphere. 18.1 g compound represented by formula (15) below was added to the slurry which was then reacted at 80° C. for 8 hours for polyoxyalkylation.

(15)

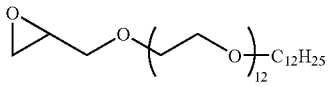

After the reaction was finished, the reaction solution was neutralized with acetic acid, and the reaction product was separated by filtration. The reaction product was washed twice with 700 g isopropyl alcohol and dried for 1 day at 60° C. under reduced pressure to give 152 g polyoxyalkylated hydroxyethyl cellulose derivative (polysaccharide derivative (a-3)).

The degree of substitution of substituents including polyoxyalkylene groups in the resulting polysaccharide derivative (a-3) was 0.009.

Synthesis Example 3

Synthesis Example of Polysaccharide Derivative (a-4)

80 g of hydroxyethyl cellulose having a weight-average molecular weight of 500,000 wherein the substitution degree of hydroxyethyl groups was 1.8 (HEC-QP4400H, manufactured by Union Carbide), 640 g of isopropyl alcohol with a water content of 80%, and 5.34 g of 48% aqueous sodium hydroxide were mixed to prepare a slurry which was then stirred for 30 minutes at room temperature in a nitrogen atmosphere. 12.78 g compound represented by the above formula (15) was added to the slurry which was then reacted at 80° C. for 8 hours for polyoxyalkylation. After the reaction was finished, the reaction solution was neutralized with acetic acid, and the reaction product was separated by filtration. The reaction product was washed twice with 500 g isopropyl alcohol and dried for 1 day at 60° C. under reduced pressure to give 73 g polyoxyalkylated hydroxyethyl cellulose derivative (polysaccharide derivative (a-4)).

The degree of substitution of substituents including polyoxyalkylene groups in the resulting polysaccharide derivative (a-4) was 0.004.

Synthesis Example 4

Synthesis Example of Polysaccharide Derivative (a-5)

160 g of hydroxyethyl cellulose having a weight-average molecular weight of 200,000 wherein the substitution degree of hydroxyethyl groups was 2.5 (NATROZOL250G, manufactured by Hercules), 1280 g of isopropyl alcohol with a water content of 80%, and 9.8 g of 48% aqueous sodium hydroxide were mixed to prepare a slurry which was then stirred for 30 minutes at room temperature in a nitrogen atmosphere. 31.8 g compound represented by formula (16) below was added to the slurry which was then reacted at 80° C. for 8 hours for polyoxyalkylation.

(16)

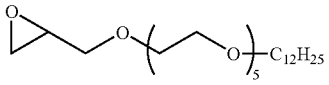

After the reaction was finished, the reaction solution was neutralized with acetic acid, and the reaction product was separated by filtration. The reaction product was washed twice with 700 g isopropyl alcohol and dried for 1 day at 60° C. under reduced pressure to give 152 g polyoxyalkylated hydroxyethyl cellulose derivative (polysaccharide derivative (a-5)).

The degree of substitution of substituents including polyoxyalkylene groups in the resulting polysaccharide derivative (a-5) was 0.015.

Syntheses Example 5

Synthesis of Polysaccharide Derivative (a-6)

100 g of hydroxyethyl cellulose having a weight-average molecular weight of 200,000 and a substitution degree of hydroxyethyl groups of 2.5, SE400, manufactured by Daicel Chemical Industries, Ltd., 500 g of isopropyl alcohol with a water content of 80%, 2.24 g of tetradecyl glycidyl ether represented by the formula (17) and 6.11 g of 48% aqueous sodium hydroxide were mixed with one another to obtain a slurry. The slurry was then stirred, while nitrogen gas was bubbled, for 30 minutes at room temperature. After the nitrogen-bubbling had been finished, alkylation was conducted with reflux, under nitrogen atmosphere at the normal pressure for 9 hours. After the reaction, the product mixture was cooled to 30° C. and then neutralized with acetic acid and the reaction product was separated by filtration. The reaction product was washed twice with 700 g of isopropyl alcohol and dried for 1 day at 65° C. at a reduced pressure to obtain 93 g of an alkylated hydroxyethyl cellulose derivative (polysaccharide derivative (a-6)). The substitution degree of alkyl group of the obtained polysaccharide derivative (a-6) was 0.006.

(17)

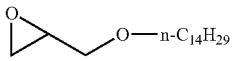

Syntheses Example 6

Synthesis of Polysaccharide Derivative (a-7)

500 g of hydroxyethyl cellulose having a weight-average molecular weight of 200,000 and a substitution degree of hydroxyethyl groups of 2.5, SE400, manufactured by Daicel Chemical Industries, Ltd., 500 g of isopropyl alcohol with a water content of 80%, 1.66 g of hexadecyl glycidyl ether represented by the formula (18) and 6.11 g of 48% aqueous sodium hydroxide were mixed with one another to obtain a slurry. The slurry was then stirred, while nitrogen gas was bubbled, for 30 minutes at room temperature. After the nitrogen-bubbling had been finished, alkylation was conducted with reflux at the normal pressure under nitrogen atmosphere for 9 hours. After the reaction, the reaction mixture was cooled to 30° C. and neutralized with acetic acid. The reaction product was separated by filtration. The reaction product was washed twice with 700 g of isopropyl alcohol and dried for 1 day at 65° C. at a reduced pressure to obtain 93 g of an alkylated hydroxyethyl cellulose derivative (polysaccharide derivative (a-7)). The substitution degree of the alkyl group of the obtained polysaccharide derivative (a-7) was 0.004.

(18)

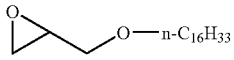

Example 1

The components (a) to (e) shown in Table 1 were used to prepare fiber-treating agent compositions having the compositions shown in Table 1 by a method shown below. Clothes were treated with each of the resulting compositions by a method shown below, and the degree of adsorption thereof was determined. The storage stability of the compositions obtained by the method shown below was also evaluated. The results are shown in Table 1.

<Method of Preparing the Fiber-Treating Agent Composition>

The component (a), 1/5 (mass ratio) of the component (b), and the component (e) in Table 1 are added to 15% (25° C.) of the component (c) necessary for the composition in Table 1 and stirred at 25° C. for 1 hour, and then the component (d1) is added, and the mixture is further stirred for 20 minutes, and the remainder of the component (b) is added. Then, the mixture is stirred at 25° C. for 1 hour, and the temperature of the resulting blend is increased to 60° C., and the blend is stirred for 1 hour to give a composition. The composition obtained by the method described above is cooled over 30 minutes to 40° C., and the remainder of the component (c) (40° C.) in an amount from which the amount of the component (c) necessary for preparing a composition containing 30% component (d2) was subtracted is added to the above composition and stirred for 30 minutes. A separately prepared composition (40° C.) containing 30% component (d2) is added to the composition and stirred for 30 minutes, followed by pH adjustment and decreasing the temperature of the blend over 1 hour to 25° C. to give a fiber-treating agent composition containing an oil-in-water-type emulsion. The stirring rate is 400 rpm in all steps.

<Method of Measuring the Degree of Adsorption>

A cotton calico #2003 (manufactured by Yato Shoten) was washed with a commercial detergent ("Attack", manufactured by Kao Corporation; detergent concentration of 0.0667 mass %, tap water was used, water temperature of 20° C., washing for 10 minutes and then rinsing with running water for 15 minutes and followed by dehydration for 5 minutes) in a two-bath washing machine (two-bath washing machine VH-360S1 manufactured by Toshiba Corporation) and then air-dried. This cotton calico was cut into test clothes of about 16 g×8 sheets (about 150 g in total). 2 g of each composition was added to 2250 ml of 4° hard water at 20° C. and then stirred for 1 minute (in a National electric washing machine NA-35). Thereafter, the test cloth was added and treated for 5 minutes. After treatment was finished, the cloth was dehydrated (3 minutes) and dried overnight (air-dried). After air-drying, 1 g piece was cut off from the treated cloth and then placed in a screw vial, and after 50 g chloroform was added to the vial, the sample was left overnight. Thereafter, the sample was sonicated for 30 minutes in a bath sonicator. 1.0 ml standard solution (internal standard: a solution prepared by dissolving about 500 mg dimethyl terephthalate in 100 ml) was added to the resulting sample solution and stirred vigorously. From the resulting solution, the chloroform was removed by distillation in an evaporator. The residues were dissolved in 1.5 ml heavy chloroform and measured by $^1$H-NMR to calculate the component (b).

The degree of adsorption (%) of the composition was calculated from the amount of dimethyl terephthalate in the standard solution, a peak area of aromatic-ring protons of dimethyl terephthalate, and a peak area of methyl groups in the silicone molecule.

<Method of Evaluating Storage Stability>

The fiber-treating agent compositions were stored for 1 month at room temperature and at 40° C. respectively and evaluated under the following criteria by observing occurrence of separation with the naked eye.

TABLE 1

| | | Products of the invention | | | | | | | | | Comparative products | | |
|---|---|---|---|---|---|---|---|---|---|---|---|---|---|
| | | 1 | 2 | 3 | 4 | 5 | 6 | 7 | 8 | 9 | 1 | 2 | 3 |
| Fiber-treating composition (%) | (a-1) | 2 | 2 | | | | | | | | | | |
| | (a-2) | | | 1.5 | | | | | | | | | |
| | (a-3) | | | | 1.2 | 1.2 | | | | | | | |
| | (a-4) | | | | | | 0.8 | | | | | | |
| | (a-5) | | | | | | | 1.2 | | | | | 0.5 |
| | (a-6) | | | | | | | | 1.1 | | | | |
| | (a-7) | | | | | | | | | 0.8 | | | |
| | (a'-1) | | | | | | | | | | 2 | | |
| | (a'-2) | | | | | | | | | | | 2 | |
| | (b-1) | 8 | 8 | | | | | | | | 8 | | |
| | (b-2) | | | 8 | | | | | | | | 8 | |
| | (b-3) | | | | 8 | | | | | | | | |
| | (b-4) | | | | | 8 | | | | | | | |
| | (b-5) | | | | | | 8 | 8 | 8 | 8 | | | |
| | (b'-1) | | | | | | | | | | | | 30 |
| | (d1-1) | 0.5 | 0.5 | 0.5 | 0.5 | 0.5 | 0.5 | 0.5 | 0.5 | 0.5 | 1 | 1 | 1 |
| | (d2-2-1) | | 10 | | | | | | | | | | |
| | (d2-1-1) | | 0.5 | | | | | | | | | | |
| | (e-1) | 16 | 16 | 16 | 16 | 16 | 16 | 16 | 16 | 16 | 16 | 16 | 16 |
| | (c) | Balance | Balance | Balance | Balance | Balance | Balance | Balance | Balance | Balance | Balance | Balance | Balance |
| Total | | 100 | 100 | 100 | 100 | 100 | 100 | 100 | 100 | 100 | 100 | 100 | 100 |
| pH* | | 7 | 7 | 7 | 7 | 7 | 7 | 7 | 7 | 7 | 7 | 7 | 7 |
| Degree of absorption (%) | | 70 | 70 | 70 | 70 | 75 | 70 | 70 | 70 | 70 | 15 | 15 | 15 |
| Storage stability | Room temperature, 1 month | ○ | ○ | ○ | ○ | ○ | ○ | ○ | ○ | ○ | X | X | X |
| | 40° C., 1 month | ○ | ○ | ○ | ○ | ○ | ○ | ○ | ○ | ○ | X | X | X |

○: Separation is not observed.
X: Separated.
*pH at 20° C., which was adjusted with 1/10 N aqueous sulfuric acid and 1/10 N aqueous sodium hydroxide.

The invention claimed is:

1. A fiber-treating agent composition comprising an oil-in-water emulsion wherein composition (A) comprising the following component (b) is emulsified with the following component (a), component (a): a polymer compound of (iii) a polysaccharide derivative wherein part or all of hydrogen atoms of hydroxy groups of the polysaccharide derivative are substituted by groups represented by the formula (3-1):

$$R^{3d}\text{-}(E^3)_{3p}\text{-}(R^{3e})_{3q}\text{—} \quad (3\text{-}1)$$

wherein $R^{3d}$ represents a C8 to C22 linear or branched hydrocarbon group which may be substituted with a hydroxy or oxo group; $R^{3e}$ represents a C1 to C6 linear or branched alkylene group which may be substituted with a hydroxy or oxo group, the total carbon number of $R^{3d}$ and $R^{3e}$ is 8 to 30; and $E^3$ represents a group selected from —O—, —COO— and —OCO—; and 3p and 3q are independently 0 or 1, and component (b): a polyether-modified silicone having an HLB value of larger than zero to 7 or smaller;

wherein the mass ratio of the component (a) to the component (b) in the composition, that is, the component (a)/component (b), is 9/100 to 30/100.

2. The fiber-treating agent composition according to claim 1, wherein the composition (A) further comprises a water-soluble solvent (component (e)).

3. The fiber-treating agent composition according to claim 1, which comprises an oil-in-water emulsion obtained by adding water (component (c)) to the composition (A) under stirring.

4. The fiber-treating agent composition according to claim 1, which comprises the component (a) in an amount of 0.01 to 10 mass %, the component (b) in an amount of 0.1 to 50 mass %, and the component (c) in an amount of 40 to 95 mass %.

5. The fiber-treating agent composition according to claim 1, which comprises capsular particles having a particle diameter of 0.1 to 50 μm and comprising the component (a) as the shell and the component (b) included.

* * * * *